United States Patent [19]

Winchell

[11] 3,973,882

[45] Aug. 10, 1976

[54] ROTARY COMBUSTION ENGINE APEX SEAL ARRANGEMENT

[75] Inventor: Frank J. Winchell, Orchard Lake, Mich.

[73] Assignee: General Motors Corporation, Detroit, Mich.

[22] Filed: Mar. 17, 1975

[21] Appl. No.: 558,660

[52] U.S. Cl. ..... 418/121; 418/122

[51] Int. Cl.[2] ..... F01C 19/02

[58] Field of Search ..... 418/119, 120, 121–124, 418/113

[56] References Cited

UNITED STATES PATENTS

| | | | |
|---|---|---|---|
| 1,292,324 | 1/1919 | Inshaw | 418/121 |
| 3,245,387 | 4/1966 | Froede | 418/120 |
| 3,251,541 | 5/1966 | Paschke | 418/124 |
| 3,712,767 | 1/1973 | Beutter | 418/121 |
| 3,716,313 | 2/1973 | Lamm | 418/121 |
| 3,853,439 | 12/1974 | Jones | 418/121 |
| 3,885,898 | 5/1975 | Lamm | 418/122 |

*Primary Examiner*—C. J. Husar

*Attorney, Agent, or Firm*—Ronald L. Phillips

[57] ABSTRACT

A rotary combustion engine apex seal arrangement comprising two end-to-end apex seal segments forced by a spring biased central wedge to engage a peripheral wall at their outer sealing surfaces and also to engage the respective adjoining side walls at their outer ends thereby leaving a gap only between their inner ends.

3 Claims, 3 Drawing Figures

ROTARY COMBUSTION ENGINE APEX SEAL ARRANGEMENT

This invention relates to a rotary combustion engine apex seal arrangement and more particularly to such an arrangement where the seal comprises two end-to-end apex seal segments or pieces engaged by a spring biased central wedge.

Rotary combustion engine apex seals of the type comprising a gas pressure biased rigid bar experience high bending stresses in attempting to conform to the peripheral wall on which they slide as the wall changes to an arcuate shape lengthwise of the apex seal because of the gas pressure in the chambers and/or heat expansion. It is also known that these bending stresses can become excessively high where the apex seal passes over a peripheral exhaust port and is then supported only adjacent its two ends. In the continuing development of apex seals, a primary concern has been to further reduce leakage past the apex seal and improve heat transfer from the seal to the housings and substantial improvements have been made with a multi-segment apex seal arrangement as compared with a one-piece apex seal. Typically, the multi-piece apex seal has a long main segment which spans substantially the width of the peripheral wall and engages this wall and one or two small end segments which have ramp engagement with the main segment and engage the side walls. However, the main segment remained rigid with the result that high bending stresses were not avoided or relieved while the leakage was reduced and heat transfer improved. Examples of such multi-segment apex seals are disclosed in U.S. Pat. Nos. 3,556,695, 3,400,691 and 3,712,767. On the other hand, it has been proposed to make the main apex seal segment relatively flexible in bending so as to conform with the changing contour of the peripheral wall as disclosed in U.S. Pat. No. 3,716,313. However, the change in contour is not uniform completely around the peripheral wall and fatigue life of such a seal and its possible protrusion out into a peripheral port becomes a concern. Another approach to maintaining apex seal contact with the changing contour of the peripheral wall has been to provide a pair of juxtaposed apex seals at each rotor apex which are each divided into segments with the gaps between the segments arranged so as not to align as disclosed in U.S. Pat. No. 3,253,581. However, in the latter type of apex seal arrangement leakage gaps remain at the opposite ends of the seals and one or more of the many segments could protrude out into a peripheral intake and/or exhaust port as they pass. There thus remains a need for a very simple yet readily conformable low leakage apex seal arrangement that experiences only low bending stresses and can be used with a peripheral intake and/or exhaust port.

A recently successful solution is to provide two short apex seal segments which are arranged end-to-end and have ramps on their underneath sides contacted directly by a common spring so that they engage the peripheral wall at their outer sealing surfaces and also engage the respective adjoining side walls at their outer ends with the result that there is only a single leakage gap between their inner ends. This arrangement is disclosed in detail in copending U.S. patent application Ser. No. 528,433 filed Nov. 29, 1974 and assigned to the assignee of this invention. However, with such an arrangement it would be advantageous if the two apex seal segments could be better sealed against leakage in the slot they occupy and if the space beneath the seal into which gaseous mixture from the chambers can enter could be substantially reduced to thus reduce undesirable emissions.

According to the present invention, these tasks are accomplished with a relatively simple apex seal arrangement comprising two short apex seal segments which are arranged end-to-end in a slot in the rotor and are forced against both the peripheral wall and the respective adjoining side walls by a spring load central wedge of isosceles triangle shape whereby the only leakage gap at the peripheral wall is between the inner ends of the apex seal segments. The apex seal segments have a ramp along their underneath side engaged by one side of the wedge and the ramp and side angles are made slightly different, i.e. purposely mismatched, so that in addition to providing the desired directional forces on the apex seal segments the cooperating wedge side and segment ramp contact occurs at the inner end of the apex seal segment and thus provides sealing therebetween in the slot adjacent the single central leakage gap. Then as the peripheral wall changes with gas pressure and/or heat expansion and the apex seal segments tilt slightly to conform thereto, the contacting wedge sides and segment ramps come into full engagement for better sealing along their juncture. Furthermore, the triangular shape of the central wedge effectively serves to occupy a substantially large volume underneath the two apex seal segments thus minimizing the space underneath the seal to which gas mixture from the chambers can enter.

Thus, one of the beneficial features of the apex seal arrangement in the aforementioned U.S. patent application Ser. No. 528,433 is retained in that the apex seal segment inner ends can still be located so that they are supported by a bridge across the exhaust port as disclosed in copending U.S. Ser. No. 519,813 filed Nov. 1, 1974 and assigned to the assignee of this invention. Also, there remains only a single leakage gap at the peripheral wall and this is between the inner ends of the apex seal segments rather than at their outer ends and since the height of this leakage gap is smaller than an end gap for example, there is substantially reduced leakage in relation thereto which results in more compression pressure, lower fuel consumption, higher power and lower hydrocarbon emissions. In addition, the central gap provides for a further reduction in hydrocarbons because any leakage therethrough is more likely to be burned gas rather than the unburned gas that can leak past an end as in certain other apex seal arrangements.

An object of the present invention is to provide a new and improved apex seal arrangement.

Another object is to provide a new and improved rotary combustion engine apex seal arrangement having good conformability with the peripheral wall it engages as the wall grows concave because of the gas pressure in the chambers and/or heat expansion and also having good internal sealing and with a very small amount of space left beneath the seal.

Another object is to provide in a rotary combustion engine a multi-segment apex seal arrangement comprising end-to-end sealing segments which are forced by a spring biased central wedge to engage a peripheral wall at their outer sealing surfaces and also to engage the adjoining side walls at their respective outer ends thereby leaving only a small gap between their inner ends and a small space underneath the seal.

Another object is to provide in a rotary combustion engine a multi-segment apex seal arrangement comprising end-to-end seal segments which are forced by a spring biased central wedge with mismatched ramp angle engagement to engage a peripheral wall at their outer sealing surfaces and also to engage the adjoining side walls at their respective outer ends while leaving only a small gap between their inner ends and a small space underneath the seal and effectively providing initial sealing between the wedge and seal segments adjacent the gap and wherein the inner ends are located so as to be supported as they travel past a peripheral intake and/or exhaust port by a bridge thereacross in the peripheral wall.

These and other objects of the present invention will be more apparent from the following drawing and description in which.

Figure 1:
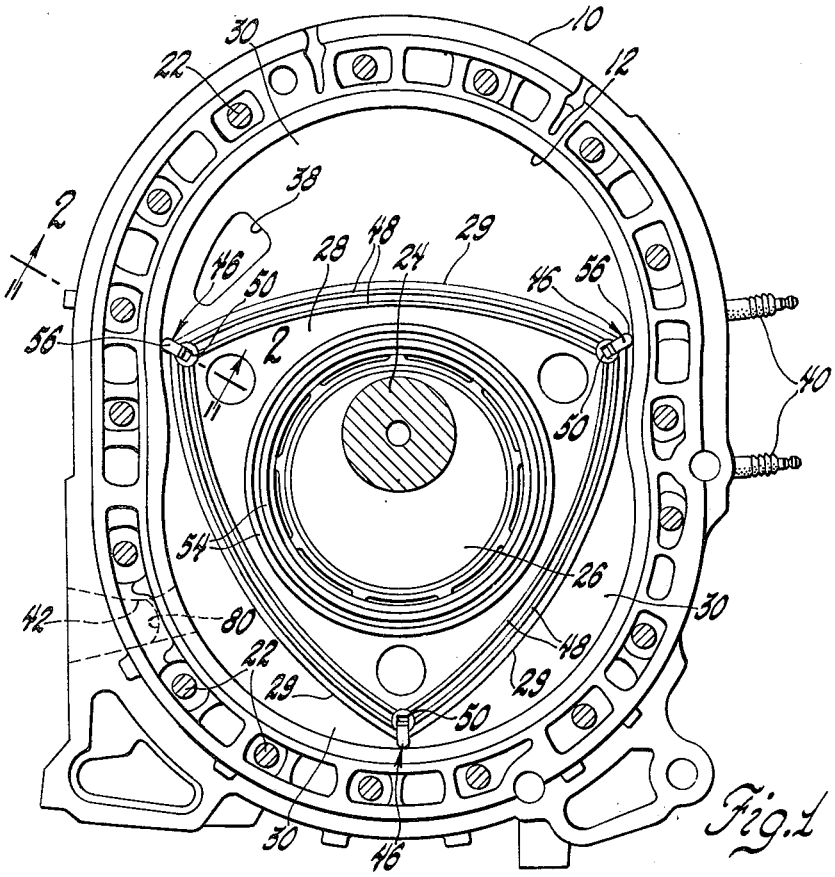
FIG. 1 is a cross-sectional view with parts in section of a rotary combustion engine having an apex seal arrangement according to the present invention.
Figure 2:
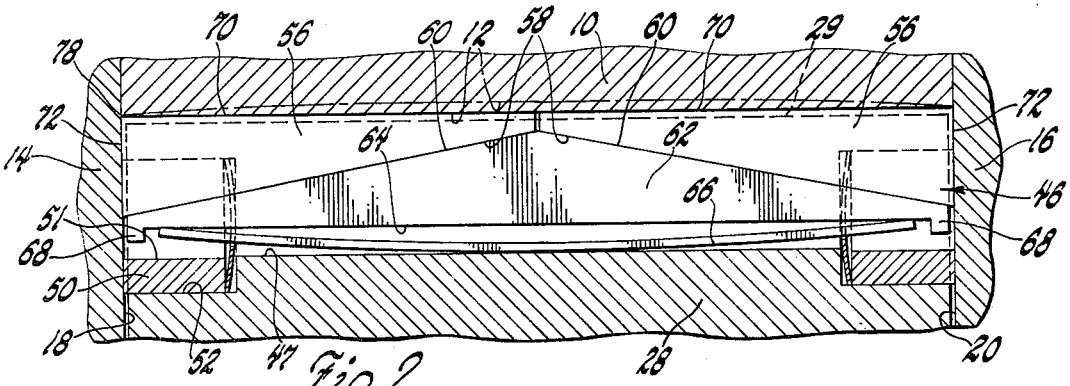
FIG. 2 is an enlarged view taken along the line 2—2 in FIG. 1.

The apex seal arrangement according to the present invention is for use in a rotary internal combustion engine as shown in FIGS. 1 and 2. The engine generally comprises a rotor housing 10 having an inwardly facing inner peripheral wall 12 and a pair of end housings 14 and 16 having parallel, oppositely facing inner side walls 18 and 20 respectively. The housings are secured together by bolts 22 with the inner housing walls 12, 18 and 20 cooperatively providing a cavity. A crankshaft 24 is rotatably supported in the end housings 14 and 16 and has an eccentric 26 on which a rotor 28 is rotatably mounted in the cavity. The inner peripheral wall 12 parallels a two-lobe epitrochoid and the rotor 28 has the general shape of a triangle with faces 29 that cooperate with the inner peripheral wall and also the side walls 18 and 20 to define three variable volume working chambers 30 that are spaced about and move with the rotor as it rotates about the eccentric 26 while the crankshaft 24 turns.

Each of the working chambers 30 is forced to sequentially expand and contract between minimum and maximum volume twice during each rotor revolution in fixed relation to the housing by forcing the rotor 28 to rotate at one-third the speed of the crankshaft 24. This is accomplished by gearing, not shown, comprising an internal tooth gear which is concentric and integral with one side of the rotor 28 and meshes with an external tooth gear which is received with clearance about and is concentric with the crankshaft 24 and is made stationary by being secured to one of the end housings. The rotary gear has one and one-half times the number of teeth as the stationary gear to provide the required speed ratio of 3:1 between the crankshaft and rotor.

A combustible air-fuel mixture from a suitable carburetor and intake manifold arrangement, not shown, is made available to the working chambers 30 by intake passages in the end housings which terminate with oppositely facing intake ports 38 in the side walls 18 and 20 with the intake ports being located so that they open to the working chambers as they expand. Then as the chambers contract the rotor 28 closes the working chambers to the intake parts and the trapped fuel mixture is then compressed and when the rotor faces 29 of the respective chambers are in the vicinity of top-dead-center, the compressed mixture is ignited by a pair of spark plugs 40 which are mounted on the rotor housing 10 with their electrodes exposed through the inner peripheral wall 12 to the passing working chambers. Upon ignition of the mixture in each working chamber the peripheral wall takes the reaction forcing the rotor 28 to continue its forward motion while the gas is expanding. The leading rotor apex of each working chamber eventually traverses an exhaust port 42 in the inner peripheral wall 12 whereby the exhaust products are then exhausted to an exhaust manifold, not shown.

Sealing of the working chambers 30 for such 4-cycle operation is provided by three apex seal arrangements 46 according to the present invention which are each mounted in an axially extending radially outwardly facing slot 47 at the apexes or corners of the rotor and extend the width thereof as described in more detail later. Three pairs of side seals 48 are mounted in axially outwardly facing slots in each rotor side and extend adjacent the rotor faces between two apex seal arrangements 46 and are spring biased outwardly to engage the opposite side wall. In addition, three cylindrical corner seals 50 are mounted in cylindrical holes 52 in each rotor side with each corner seal having a slot 51 receiving one end of an apex seal and providing sealing between adjacent ends of two pairs of side seals and this apex seal and being spring biased outwardly to engage the opposite side wall. In addition to the gas seals carried on the rotor 28 there is provided in each rotor side a pair of oil seals 54 that are located radially inwardly of the side seals 48 in axially outwardly facing circular grooves. The oil seals 54 are spring biased outwardly to engage the opposite side wall to prevent the oil supplied for rotor cooling and bearing lubrication from reaching the radially outwardly located gas seals.

Describing now the details of the apex seal arrangement 46 according to the present invention, there are two identical short apex seal segments or bars 56 of generally rectangular cross-section shape which are arranged end-to-end in the apex seal slot 47. The short apex seal segments have a flat ramp 58 extending completely along their underneath side which is engaged by one of the two equal sides 60 of a spring loaded central wedge 62 having an isosceles triangle shape. The base 64 of the central wedge 62 extends parallel to and faces the bottom of the apex seal slot 47 and leaves only just enough working room beneath the seal for a leaf spring 66. The spring 66 seats at its center on the bottom of slot 47 and has its opposite ends extending into the adjoining corner seal slots 51 and engaging the base 64 of the central wedge near its opposite ends whereby the central wedge is normally urged radially outward. The wedge base 64 is provided with radially inwardly extending projections 68 at the two ends to thus trap the spring in the axial direction and prevent it from ever rubbing one of the side walls.

Figure 3:
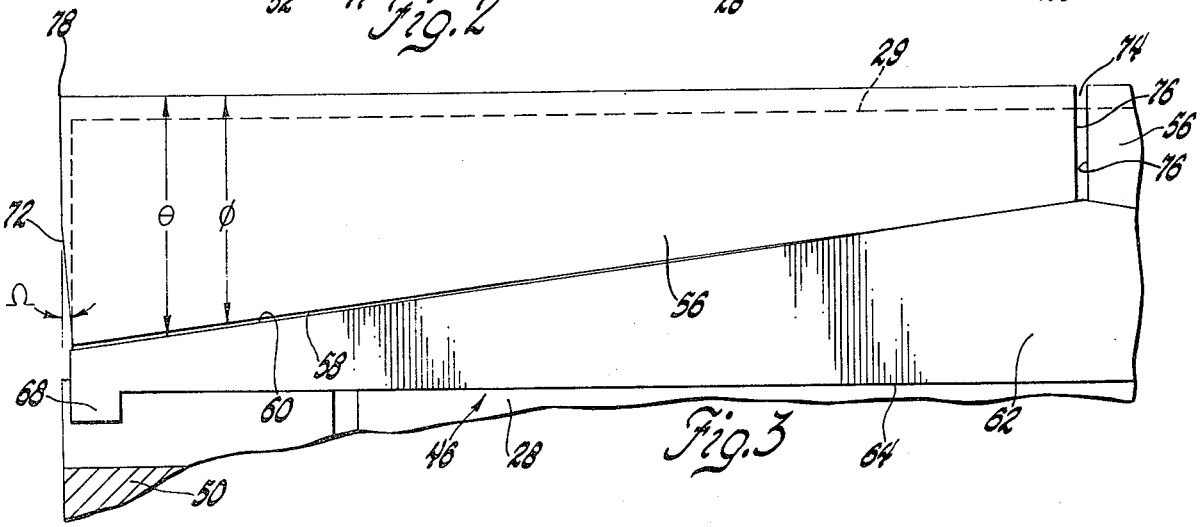
FIG. 3 is an enlarged view of a portion of the seal from FIG. 2.

The central wedge 62 which is biased outward mainly by the gas pressure from the chambers acting on its bottom 64 urges the apex seal segments 56 radially and axially outward to thus cause the rounded outer sealing surfaces 70 and flat end sealing surfaces 72 thereon to engage the respective peripheral wall 12 and adjoining side walls 18 and 20, the ramp angle being selected to provide a desirably higher radial force component. Thus, the apex seal segments 56 are urged apart leaving a gap 74 between their inner ends 76 which is made as small as possible to limit leakage therethrough. As can be seen in FIG. 3, the center leakage gap whose height is measured from face 29 of the rotor adjacent the slot 47 to the peripheral wall 12 is much smaller than what the leakage gap would be at the end of the apex seal recognizing that the leakage gap in the latter case would have a height measured from the top of the radially inwardly located corner seal 50 to the peripheral wall. Since the only leakage gap is thus substantially reduced there is more compression pressure, lower fuel consumption, higher power and lower hydrocarbon emissions as compared with a conventional one piece seal. Furthermore, since the leakage gap is located at the center rather than at the end, there is provided a further reduction in hydrocarbons since any leakage therethrough is more likely to be burned gas rather than unburned gas out at the outer ends.

As best shown in FIG. 3, the angle $\theta$ of the wedge sides 60 is made slightly steeper than the angle $\phi$ of the apex seal segment ramps 58 so that rather than having matched angles which then could be randomly mismatched because of manufacturing tolerances and assembly practices, there is purposely provided a predetermined mismatching within manufacturing tolerances that causes the wedge sides 60 to contact the ramps 58 at their inner ends 76 adjacent the leakage gap 74. As a result, sealing is provided thereby between the apex seal segments 56 and the central wedge 62 close to where there is leakage rather than letting manufacturing tolerances permit their contact to be made at the opposite end and thereby provide a greater leakage potential within the apex seal slot such as could occur if the angles were designed equal. Furthermore, this angular mismatch is determined so that as the peripheral wall 12 changes to a concave shape as shown in phantom-line in FIG. 2 because of the gas pressure in the chambers and/or heat expansion, the gas pressure and relatively small spring force acting radially outward on the bottom 64 of the central wedge 62 forces slight pivotal movement of the apex seal segments 56 in opposite directions about their respective outer edges 78 whereupon the central wedge sides 60 then come into full contact with the apex seal segment ramps 58 and there is provided a tight seal all along their interfaces to further prevent internal leakage. As best shown in FIG. 3, a small chamfer $\Omega$ is provided at the lower outer edge of each of the segments to prevent this edge from rubbing on the side walls because of the radially inner portion of the segments expanding lengthwise with heat more than the outer region adjacent the sealing surface 70 recognizing that the heat is being carried away through the latter by the rotor housing.

To illustrate the magnitude of the above parameters, it was determined that the angles and angular difference for producing all the above results in one actual installation were $\theta = 7°$–30 feet, $\phi = 7°$–20 feet and $\Omega = 1°$. Furthermore, it can be seen that the central wedge 62 because of its configuration fills all but the space required under the apex seal for the spring and thus there is minimum space beneath the apex seal to which gaseous mixture from the chambers can enter which has the result of further decreasing undesirable emission. It will also be appreciated that the two short apex seal segments 56 only need to conform to their half of the changing peripheral wall contour and thus experience much lower bending stresses while providing easier conformability than a full length apex seal. Furthermore, this arrangement permits the apex seal segments 56 to be made from material best suited for sealing and conformability requirements while the central wedge 62 can be made from material best suited for its functions as a wedge and filler. For example, the rotor housing could be aluminum and the peripheral wall could be chromium and in that case the apex seal segments could be formed of particulate carbon interdispersed with and metallurgically bonded to a copper base alloy containing lead and titanium and optionally tin as disclosed in copending U.S. patent application Ser. No. 356,611 filed May 2, 1973 and assigned to the assignee of this invention. In contrast the central wedge 62 in that the case could be made of sintered or cast iron, steel or some other suitable metallic material with the necessary beam strength.

It will also be appreciated that the apex seal arrangement 46 according to the present invention can be used with a peripheral exhaust port in addition to side porting without the possibility of protruding outward into such port. This is possible with the use of a bridge 80 in the inner peripheral wall across the center of the port 42 as disclosed in copending U.S. Ser. No. 519,813 filed Nov. 1, 1974 and assigned to the assignee of this invention. With this arrangement the inner ends 76 are supported by the bridge 80 as they pass over the port 42 and still experience only low bending stress throughout their travel around the peripheral wall. It will also be appreciated that the intake porting could be located in the peripheral wall and the exhaust porting located in the side walls or both the intake and exhaust ports could be in the peripheral wall. In either case it is intended that with a peripheral port that the inner ends of the apex seal segments are located so that they are supported by a bridge across the port as they pass over.

The above described embodiment is illustrative of the invention which may be modified within the scope of the appended claims.

I claim:

1. An apex seal arrangement for a rotary combustion engine having an inner peripheral wall and oppositely facing side walls and a rotor between the side walls with apexes that remain adjacent the peripheral wall to provide expansible gas chambers as the rotor rotates, said apex seal arrangement comprising a pair of apex seal segments positioned in a slot in each rotor apex with oppositely facing inner ends and outer ends that face the respective side walls, said apex seal segments having a peripheral sealing surface on an outer side and an end sealing surface on the outer end and a ramp completely along an underneath side inclined relative to the peripheral wall and adjacent side wall, a central wedge positioned in the slot with a base facing the bottom of the slot and sides engaging said ramps on the respective apex seal segments so that when a radially outward force is applied to said wedge said sides operate on said ramps to urge said apex seal segments in directions bringing said peripheral sealing surfaces radially outward against the peripheral wall and said end sealing surfaces axially outward against the respective side walls whereby a leakage gap is left only between the oppositely facing inner ends of said apex seal segments radially outward of the slot, and a spring positioned in the slot for seating on the bottom of the slot and engaging said base of said central wedge to provide together with gas pressure from the chambers a radially outward force on said central wedge.

2. An apex seal arrangement for a rotary combustion engine having an inner peripheral wall and oppositely facing side walls and a rotor between the side walls with apexes that remain adjacent the peripheral wall to provide expansible gas chambers as the rotor rotates, said apex seal arrangement comprising a pair of apex seal segments positioned in a slot in each rotor apex with oppositely facing inner ends and outer ends that face the respective side walls, said apex seal segments having a peripheral sealing surface on an outer side and an end sealing surface on the outer end and a ramp completely along an underneath side inclined relative to the peripheral wall and adjacent side wall, a central wedge positioned in the slot with a base facing the bottom of the slot and sides engaging said ramps on the respective apex seal segments so that when a radially outward force is applied to said wedge said sides operate on said ramps to urge said apex seal segments in directions bringing said peripheral sealing surfaces radially outward against the peripheral wall and said end sealing surfaces axially outward against the respective side walls whereby a leakage gap is left only between the oppositely facing inner ends of said apex seal segments radially outward of the slot, said sides of said central wedge having a predetermined slightly steeper angle than that of said ramps so that said sides initially positively engage said ramps at said inner ends adjacent said leakage gap and whereafter as the peripheral wall changes contour with gas pressure and/or heat expansion and grows to a concave shape said apex seal segments pivot slightly to permit said peripheral sealing surfaces to continue to conform to the peripheral wall while the contacting sides and ramps then come into full interface engagement, and a spring positioned in the slot for seating on the bottom of the slot and engaging said base of said central wedge to provide together with gas pressure from the chambers a radially outward force on said central wedge.

3. An apex seal arrangement for a rotary combustion engine having an inner peripheral wall and oppositely facing side walls and a rotor between the side walls with apexes that remain adjacent the peripheral wall to provide expansible gas chambers as the rotor rotates, said apex seal arrangement comprising a pair of apex seal segments positioned in a slot in each rotor apex with oppositely facing inner ends and outer ends that face the respective side walls, said apex seal segments having a peripheral sealing surface on an outer side and an end sealing surface on the outer end and a flat ramp completely along an underneath side inclined relative to the peripheral wall and adjacent side wall, a central wedge with an isosceles triangle shape positioned in the slot with a flat base extending parallel to and facing the bottom of the slot and flat sides completely underlying and engaging said ramps on the respective apex seal segments so that when a radially outward force is applied to said wedge said sides operate on said ramps to urge said apex seal segments in directions bringing said peripheral sealing surfaces radially outward against the peripheral wall and said end sealing surfaces axially outward against the respective side walls whereby a leakage gap is left only between the oppositely facing inner ends of said apex seal segments radially outward of the slot, said sides of said central wedge having a predetermined slightly steeper angle than that of said ramps so that said sides initially positively engage said ramps at said inner ends adjacent said leakage gap and whereafter as the peripheral wall changes contour with gas pressure and/or heat expansion and grows to a concave shape said apex seal segments pivot slightly outward about their outer edges to permit said peripheral sealing surfaces to continue to conform to the peripheral wall while the contacting sides and ramps then come into full interface engagement, and a spring positioned in the slot for seating at its center on the bottom of the slot and engaging near its opposite ends with said base of said central wedge to provide together with gas pressure from the chambers a radially outward force on said central wedge.

* * * * *